United States Patent [19]

Babbitt et al.

[11] Patent Number: 4,458,218

[45] Date of Patent: Jul. 3, 1984

[54] DIELECTRIC WAVEGUIDE RECIPROCAL FERRITE PHASE SHIFTER

[75] Inventors: Richard W. Babbitt, Fair Haven; Richard A. Stern, Allenwood, both of N.J.

[73] Assignee: The United States of America as represented by the Secretary of the Army, Washington, D.C.

[21] Appl. No.: 387,986

[22] Filed: Jun. 14, 1982

[51] Int. Cl.[3] ..... H01P 1/19

[52] U.S. Cl. ..... 333/158; 333/248

[58] Field of Search ..... 333/1.1, 17 L, 24.1, 333/24.2, 158, 24.3

[56] References Cited

U.S. PATENT DOCUMENTS

| | | | |
|---|---|---|---|
| 3,067,395 | 12/1962 | Waldron | 333/24.3 UX |
| 3,080,536 | 3/1963 | Dewhirst | 333/24.1 |
| 3,340,483 | 9/1967 | Clark | 333/24.1 X |
| 3,626,335 | 12/1971 | Hord et al. | 333/158 |
| 3,680,010 | 7/1972 | Buck | 333/158 |

*Primary Examiner*—Paul L. Gensler

*Attorney, Agent, or Firm*—Anthony T. Lane; Sheldon Kanars; Roy E. Gordon

[57] ABSTRACT

A dielectric waveguide reciprocal ferrite phase shifter is provided for use in a dielectric waveguide transmission line. The phase shifter is comprised of a length of ferrite of the same cross-sectional dimension as that of the dielectric waveguide and in fact becomes a section of the transmission line. The length of ferrite bears a thin plastic layer on its top and bottom surface and metal plates on each piece of plastic. The length of this multilayer structure then has a wire coil wrapped around in order to provide a d.c. magnetic biasing field along the length of the ferrite thereby enabling magnetization of the ferrite resulting in a reciprocal phase shift or change in electrical length within the structure.

15 Claims, 6 Drawing Figures

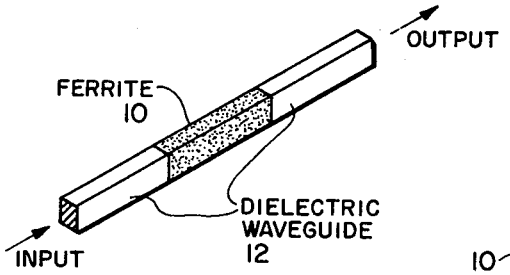
FIG. 1
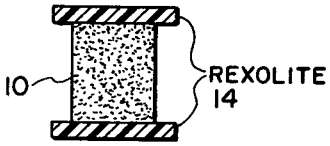
FIG. 2a
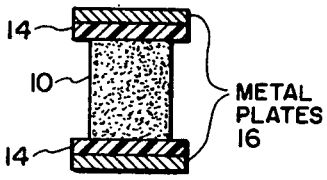
FIG. 2b
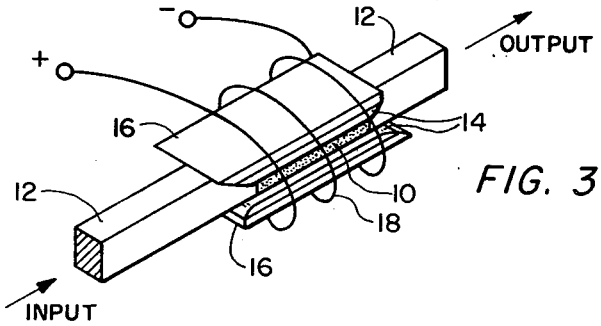
FIG. 3
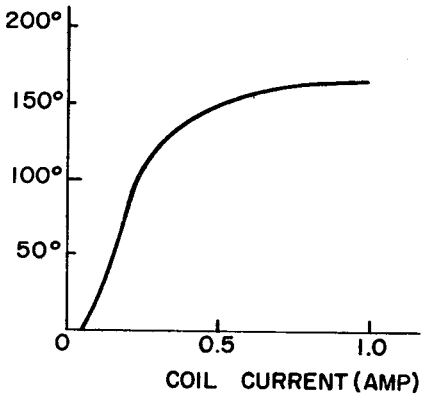
FIG. 4
FIG. 5
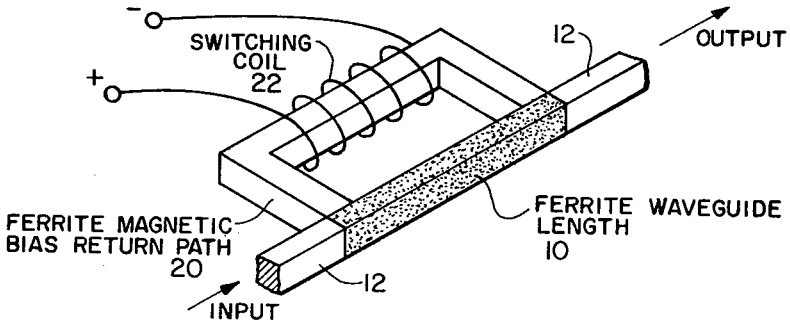

DIELECTRIC WAVEGUIDE RECIPROCAL FERRITE PHASE SHIFTER

The invention described herein may be manufactured, used, and licensed by or for the Government for governmental purposes without the payment to us of any royalty thereon.

This invention relates to a dielectric waveguide reciprocal ferrite phase shifter for use in a dielectric waveguide transmission line operating in the millimeter wave frequency region and to a dielectric waveguide transmission line containing the ferrite phase shifter.

BACKGROUND OF THE INVENTION

Previous manufacture of millimeter wave phase shifters has involved the use of ferrite toroids in various waveguide designs. The difficulty with these phase shifters is that they are not easily fabricated for use in dielectric waveguides that are presently being developed.

SUMMARY OF THE INVENTION

The general object of this invention is to provide a millimeter wave phase shifter for use in a dielectric waveguide transmission line. A further object of the invention is to provide such a millimeter wave phase shifter suitable for use in millimeter wave radar and communication systems where size, weight, efficiency and cost are of paramount importance.

It has now been found that the aforementioned objects can be attained by using a ferrite phase shifter designed for use in a dielectric waveguide transmission line.

More particularly, according to the invention, the phase shifter employs a length of ferrite of the same cross-sectional dimensions as that of the dielectric waveguide, and in fact becomes a section of the transmission line. A thin layer of plastic is placed on top and bottom of the ferrite. Two small metal plates are then placed on each piece of plastic. The length of this multilayer structure then has a wire coil wrapped around in order to provide a d.c. magnetic biasing field along the axial length of the ferrite thereby enabling magnetization of the ferrite resulting in a reciprocal phase shift or change in electrical length within the structure.

DESCRIPTION OF THE DRAWING

FIG. 1 shows a length of ferrite as a section of a dielectric waveguide transmission line.

FIG. 2*a* shows a cross-sectional view of the ferrite section bearing a thin layer of plastic on its top and bottom surface.

FIG. 2*b* shows the view of FIG. 2*a* with two metal plates placed on each piece of plastic.

FIG. 3 shows a side angular view of the complete structure.

FIG. 4 shows a plot of phase shift vs. H dc bias obtained from testing the structure of FIG. 3.

FIG. 5 shows an alternate means of magnetically biasing the ferrite.

Referring to FIG. 1, FIG. 2*a*, FIG. 2*b* and FIG. 3, the phase shifter design employs a length of ferrite, 10 of the same cross sectional dimensions as that of the dielectric waveguide, 12. The length of ferrite, 10 in fact becomes a section of the transmission line as shown. A thin layer of a suitable plastic 14 is placed on top and bottom of the length of ferrite 10. Two small metal plates 16 are then placed on each piece of plastic 14.

The length of this multilayer structure then has a wire coil 18 wrapped around in order to provide a d.c. magnetic biasing field along the axial length of the ferrite thereby enabling magnetization of the ferrite resulting in a reciprocal phase shift or change in electrical length within the structure. The phase shift achieved is proportional to the strength of the applied H dc field.

The phenomena producing the phase shift is referred to as suppressed rotation or the Reggia-Spencer effect and has been employed in conventional metal waveguide design structures at microwave frequencies. The phase shifter has been tested and found to yield 160 degrees phase shift from a 0.5" length of ferrite while exhibiting 0.5 dB insertion loss. A plot of phase shift vs H dc bias is shown in FIG. 4.

A significant advantage achieved through the use of this dielectric waveguide phase shifter design is that impedance matching into the structure is not necessary when making the transition from the dielectric guide to the ferrite guide. The permittivity ($\epsilon'$) of the dielectric ($\epsilon'=16$) and that of the ferrite ($\epsilon'=13\rightarrow16$) are nearly the same. Thus, the design and construction of the device is simplified and more efficient than conventional phase shifters. In conventional structures, a transformer section or sections are necessary to impedance match the air filled metal waveguide ($\epsilon'=1$) to that of the ferrite loaded metal guide ($\epsilon'=13\rightarrow16$).

An alternate design that works similarly but has a particularly different and more efficient means of magnetically biasing the ferrite is shown in FIG. 5. In this biasing approach, the switching coil 18 is replaced by a ferrite magnetic return path 20 allowing the switching to be accomplished by a smaller coil 22 on the return path. The advantage here is that the ferrite return path provides a low reluctance magnetic circuit resulting in reduced current drive requirements. Moreover, the ferrite can now be latched or magnetized and then have no need for a holding current in the coil to retain magnetization. The low reluctance circuit results in retention of the magnetized state. Thus, the ferrite can be switched to various phase states by means of a current pulse of the appropriate polarity and strength.

In the ferrite phase shifter of the instant invention, the ferrite acts both as the phase shifting element as well as being the dielectric media of transmission. This new embodiment exhibits low insertion loss ($<1$ dB), yields high values of phase shift, operates in the 35 GHz frequency range and is based on a simple, low cost design structure.

The phase shifter finds application in phased array antennas as well as in differential phase shift circulators and switches.

As the dielectric waveguide material 12, one may use a material having a loss tangent at microwave frequencies of less than 0.001 and a dielectric constant between about 9 and 38. Such materials are exemplified by magnesium titanate and alumina of which magnesium titanate is preferred.

As the ferrite material 10, one may use a material having a saturation magnetization greater than 3000 and a dielectric loss tangent less than 0.005. Examples of such materials are nickel zinc and lithium zinc ferrite.

The ferrite material is joined to the dielectric waveguide material 12 by means of a low loss epoxy or adhesive such as Scotch-Weld Structural Adhesive as marketed by the 3M Company of Saint Paul, Minn.

The layer of plastic 14 should combine good physical and excellent electrical properties including low loss and low dielectric constant. A particularly suitable plastic in this connection is a thermoset cross-linked styrene copolymer "Rexolite 1422" as marketed by the C-LEC company of Beverly, N.J.

As the metal plate 16, one may use a material that is a good electrical conductor such as brass, aluminum, silver etc.

We wish it to be understood that we do not desire to be limited to the exact details as described for obvious modifications will occur to a person skilled in the art.

What is claimed is:

1. A ferrite phase shifter for use in a dielectric waveguide transmission line, said ferrite phase shifter comprising a length of ferrite material of the same cross-sectional dimension as that of the dielectric waveguide and said ferrite material being so positioned as to become a section of the transmission line, a thin plastic layer on the top and bottom of the ferrite and a metal plate on each piece of plastic, and a wire coil wrapped around the length of this multilayer structure to provide a d.c. magnetic biasing field along the axil length of the ferrite for enabling the magnetization of the ferrite resulting in a reciprocal phase shift or change in electrical length within the structure.

2. A ferrite phase shifter according to claim 1 wherein the ferrite material has a saturation magnetization greater than 3000 and a dielectric loss tangent less than 0.005.

3. A ferrite phase shifter according to claim 2 wherein the ferrite material is selected from the group consisting of nickel zinc ferrite and lithium zinc ferrite.

4. A ferrite phase shifter according to claim 3 wherein the ferrite material is nickel zinc ferrite.

5. A ferrite phase shifter according to claim 3 wherein the ferrite material is lithium zinc ferrite.

6. A ferrite phase shifter according to claim 1 wherein the plastic layer is a thermoset cross-linked styrene copolymer.

7. A dielectric waveguide transmission line comprising a first length of a dielectric waveguide material and second length of a dielectric waveguide material having the same cross sectional dimensions as said first length of dielectric waveguide material, said first and second lengths being joined by a ferrite phase shifter comprising a length of ferrite of the same cross sectional dimension as that of the first and second lengths of dielectric waveguide material, a thin plastic layer on the top and bottom of the ferrite and a metal plate on each piece of plastic, and a wire coil wrapped around the length of this multilayer structure to provide a d.c. magnetic biasing field along the axial length of the ferrite resulting in a reciprocal phase shift or change in electrical length within the structure.

8. A dielectric waveguide transmission line according to claim 7 wherein the ferrite material has a saturation magnetization greater than 3000 and a dielectric loss tangent less than 0.005.

9. A dielectric waveguide transmission line according to claim 8 wherein the ferrite material is selected from the group consisting of nickel zinc ferrite and lithium zinc ferrite.

10. A dielectric waveguide transmission line according to claim 9 wherein the ferrite material is nickel zinc ferrite.

11. A dielectric waveguide transmission line according to claim 9 wherein the ferrite material is lithium zinc ferrite.

12. A dielectric waveguide transmission line according to claim 7 wherein the dielectric waveguide material has a loss tangent at microwave frequencies of less than 0.001 and a dielectric constant between about 9 and 38.

13. A dielectric waveguide transmission line according to claim 12 wherein the dielectric waveguide material is selected from the group consisting of magnesium titanate and alumina.

14. A dielectric waveguide transmission line according to claim 13 wherein the dielectric waveguide material is magnesium titanate.

15. A dielectric waveguide transmission line according to claim 13 wherein the dielectric waveguide material is alumina.

* * * * *